US010737143B1

(12) United States Patent
Raman

(10) Patent No.: US 10,737,143 B1
(45) Date of Patent: Aug. 11, 2020

(54) RETRACTABLE FINNED FOOTWEAR USED FOR SWIMMING AND WALKING

(71) Applicant: Ralston Raman, Basseterre (KN)

(72) Inventor: Ralston Raman, Basseterre (KN)

( * ) Notice: Subject to any disclaimer, the term of this patent is extended or adjusted under 35 U.S.C. 154(b) by 0 days.

(21) Appl. No.: 16/375,972

(22) Filed: Apr. 5, 2019

(51) Int. Cl.
*A63B 31/11* (2006.01)

(52) U.S. Cl.
CPC ..... *A63B 31/11* (2013.01); *A63B 2031/112* (2013.01)

(58) Field of Classification Search
CPC ..... A63B 31/00; A63B 31/08; A63B 31/11; A63B 31/14; A43B 5/00; A43B 5/08
USPC ..... 441/61, 62, 64
See application file for complete search history.

(56) References Cited

U.S. PATENT DOCUMENTS 1,688,498 A * 10/1928 Jacobsen ..... A63B 31/14 441/62
2,980,926 A * 4/1961 Wolshin ..... A63B 31/11 441/64
4,599,071 A * 7/1986 Juang ..... A63B 31/11 441/61
4,752,259 A 6/1988 Tackett
7,658,659 B1 * 2/2010 Fraser ..... A63B 31/11 441/64
8,333,020 B1 * 12/2012 Sanchez ..... A63B 31/11 441/64
2009/0170388 A1 * 7/2009 Bonis ..... A63B 31/11 441/64
2010/0203779 A1 * 8/2010 Bonis ..... A63B 31/11 441/64

* cited by examiner

*Primary Examiner* — Lars A Olson
(74) *Attorney, Agent, or Firm* — Sanchelima & Associates, P.A.; Christian Sanchelima; Jesus Sanchelima

(57) ABSTRACT

The present invention is retractable finned footwear comprising an outsole with retractable fins and a lever used to extend and retract the fins. One end of the fins is rotatably connected at back end of the outsole using fastener, while the other end is extended outside from front side of outsole. The fins can be secured at the bottom of the outsole, to facilitate the footwear suitable for walking on land. The fins can be extended from bottom of outsole by pulling the lever positioned at the back end of the outsole. The extended fins provide forward propulsive thrust to user wearing the footwear in water. After using in water, the lever can be pushed to align and secure the fins in line with the outsole. This facilitates the use of footwear both in water and land.

16 Claims, 2 Drawing Sheets

RETRACTABLE FINNED FOOTWEAR USED FOR SWIMMING AND WALKING

BACKGROUND OF THE INVENTION

1. Field of the Invention

The present disclosure relates to retractable finned footwear. More particularly, the present disclosure relates to a shoe with retractable fins used both in water and land.

2. Description of the Related Art

Footwear used in water provides a forward propulsive thrust to users while swimming. Such footwear will normally have fins to create thrust while swimming and to propel user through water. Before entering the water, or when returning to dry land after swimming, usage of such footwear in land creates instability and awkwardness to user. Many swimming footwear is designed for use in both water and land.

Applicant believes that a related reference corresponds to patent application CA2370611A1 filed by Hollywood Hopeful Productions LLC for convertible amphibious shoes for swimming and walking. The reference discloses an amphibious shoe-like structure for swimming and walking having a shoe-like structure for receiving a foot and a fin structure that provides a fin blade surface that expands in the swimming mode and collapses in the walking mode to rest adjacent to the wearer's instep. The fin structure comprises a plurality of fin arms pivotally connected to the shoe-like structure for rotating the fin arms outwardly in the swimming mode position and for rotating the fin arms inwardly towards the instep of the wearer for a walking mode position. The fin arms diverge relative to one another when rotating outwardly and converge towards one another when rotating inwardly to rest adjacent to the wearer's instep. The fin structure further comprises a flexible web member that engages with the fin arms and is of the configuration and size to accommodate the area generated by the expanding and diverging side fin arms. The convertible amphibious structure further provides for locking means to lock the fin structure in the extended swimming mode positions and for unlocking when converting into the walking mode position.

Another related application is patent number US20110104968 filed by MRJIP HOLDINGS Inc, for retractable swimming fins. The reference discloses retractable swimming fins that attach to the legs of a swimmer to aid movement through the water. In one example embodiment, a retractable swimming fin includes an upper support frame, a lower support frame, and a sliding assembly connecting the upper support frame to the lower support frame. The upper support frame is configured to be attached to the front of a swimmer's lower leg. The lower support frame includes means for aquatic propulsion and is configured to extend, in a swimming position, to a position beneath the sole of the swimmer's foot. The lower support frame is also configured to retract, in a walking position, to a position above the sole of the swimmer's foot. The walking position enables the swimmer to walk barefoot on a surface without the lower support frame substantially contacting the surface. The sliding assembly is configured to allow the lower support frame to retract.

Another related application is U.S. Pat. No. 4,752,259 filed by Edd Tackett, Hubert Tackett, for swim fins. The reference discloses a swim fin adapted to be used in the swimming or walking mode having a foot engaging portion adapted to be worn by a user and a two-part fin formed of an inner portion and outer portion which are connected to each other and rotatable with respect to each other using a suitable hinge assembly so that the outer portion may be folded on top of or under the foot wearing portion to facilitate walking and to enable the outer portion to be extended to facilitate swimming. Suitable locks are provided to maintain the fin portions in the extended or folded positions.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide retractable finned footwear that can be used both in water and land.

It is yet another object of the present invention to provide retractable finned footwear comprising an outsole with retractable fins and a lever used to extend and retract the fins.

It is yet another object of the present invention to provide retractable finned footwear in which one end of the fin is rotatably connected at back end of the outsole using a fastener, while the other end is retractable outside from front side of outsole.

It is yet another object of the present invention to provide retractable finned footwear in which fins can be secured at the bottom of the outsole, to facilitate the footwear suitable for walking on land.

It is yet another object of the present invention to provide retractable finned footwear in which fins can be extended from bottom of outsole by pulling a lever positioned at the back end of the outsole.

It is yet another object of the present invention to provide retractable finned footwear in which the extended fins provides forward propulsive thrust to user wearing the footwear in water.

It is yet another object of the present invention to provide retractable finned footwear in which after using in water, the lever can be pushed to align and secure the fins in line with the outsole.

It is yet another object of the present invention to provide retractable finned footwear that eliminates the instability and awkwardness experienced by wearers of conventional swim fins on dry land.

It is yet another object of the present invention to provide retractable finned footwear that allows wearer to feel comfortable both in water and land.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
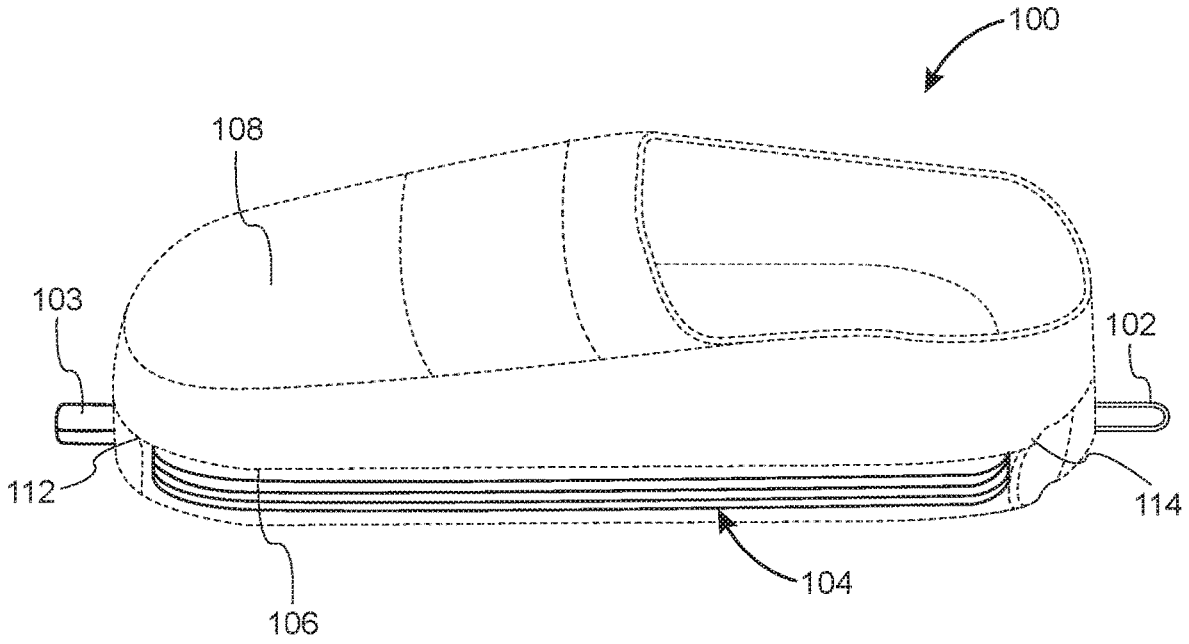
FIG. 1 represents a perspective view of retractable finned footwear 100 of present invention showing lever 102 and fins 104 secured under the outsole 106 of the footwear 100 for use in land.

FIG. 1 represents a perspective view of retractable finned footwear 100 of present invention. The retractable finned footwear 100 has an outsole 106 comprising at least one fin to result in fins 104 and at least one lever 102 attached to the outsole 106. As shown in FIG. 1, the fins 104 are aligned in line with the outsole 106 of the footwear 100 and can be used for walking on land when the fins 104 are retracted.

Figure 2:
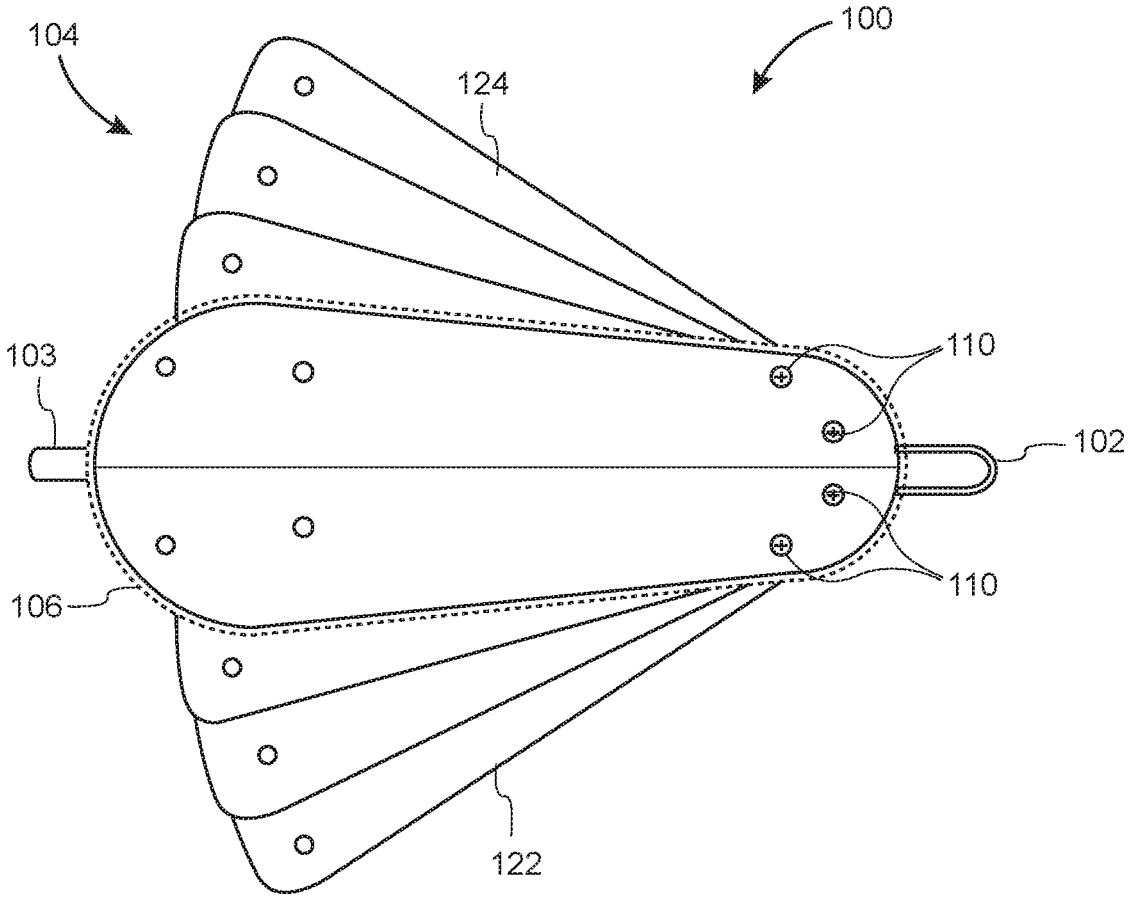
FIG. 2 represents a perspective view of retractable finned footwear 100 of present invention showing fins 104 retracted out of the outsole 106 for use in water.

FIG. 2 represents a perspective view of retractable finned footwear 100 of present invention showing fins 104 extended out of the outsole 106 for use in water. The outsole 106 has a front end 112 and a back end 114. One end of the fins 104 is rotatably connected at back end 114 of the outsole 106 using at least one fastener 110. The fastener 110 can be, for example a screw that rotatably connects the fins 104 with outsole 106. The other end of fins 104 is extended out from the front end 112 of outsole 106. The fins 104 can be extended out and retracted back in line with the outsole 106, by operating the lever 102. The upper portion 108 of the footwear 100 that covers the upper foot can be of any suitable shape, size and material that suits for both land and water environmental use. Pulling said lever 102 retracts said fins 104 and pushing said lever 102 extends said fins 104.

The fins 104 comprises at least one set of fins, each set comprising at least two fins, for example left fin 122 and right fin 124. Right fin 124 represents the fin at the right side of the footwear 100 and the left fin 122 represents the fin at the left side of the footwear 100. All the sets of fins are arranged one over the other. When the user wearing the footwear 100 wish to walk with the footwear 100, as shown in the FIG. 1, the lever 102 can be pulled to secure all sets of fins together in line with the outsole 106, such that fins 104 will not be visible when seen from the top of the footwear 100.

If the user wishes to use the footwear 100 in water, the user can pull the lever 102, such that each set of fins extend at the sides of the outsole 106. The extended fins 104 spreads at the sides of the outsole 106 one over the other. As shown in FIG. 2, all left fin 122 spreads at left side of the footwear 100 and all right fin 124 spreads at right side of the footwear 100.

It should be noted that the shape and size of the fins 104 are designed such that, when fins 104 are secured under the outsole 106 of the footwear 100, the set of fins takes the shape of the outsole 106. The material of the fins 104 and the footwear 100 are selected such that the user feels light and comfortable both in water and land. Further, the material of the footwear 100 is selected such that, it aids in forward propulsive thrust to user in water. The present invention is useful for eliminating the instability and awkwardness experienced by wearers of conventional swim fins on dry land.

Lever 102 has a suitable locking mechanism that keeps the fins 104 retracted until the lever 102 is pushed. The locking mechanism also keeps the fins 104 extended out of outsole 106 until lever 106 is pulled. The locking mechanism can be, for example, a stopper that holds the position of the fins 104 when extended or aligned with outsole 106. As shown in FIGS. 1 and 2, a mechanical connector 103 is used to connect the lever 102 with the fins 104, such that, through connector 103, the pull or push force is transferred from lever 102 to fins 104. It should be understood that connector 103 extends through outsole 106. That is from the front end 112 to the back end 114.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A retractable finned footwear used both in water and land, comprising:

a. an outsole having fins, wherein one end of said fins are rotatably connected at a back end of said outsole and other end of the fins are extend out from front side of outsole; and b. at least one lever attached to said outsole, wherein said fins are extended out from said outsole or retracted back in line with said outsole, by operating said at least one lever.

2. The retractable finned footwear of claim 1 wherein one end of each of said fins is rotatably connected at said back end of said outsole using at least one fastener.

3. The retractable finned footwear of claim 1 wherein said fins are retracted by pushing said lever, wherein retracted said fins are secured and aligned in line with said outsole.

4. The retractable finned footwear of claim 1 wherein said fins are extended by pulling said lever.

5. The retractable finned footwear of claim 1 wherein the extended said fins are used in swimming.

6. The retractable finned footwear of claim 1 wherein said fins are extended from bottom of said outsole.

7. The retractable finned footwear of claim 1 wherein said fins are secured and aligned in line with said outsole when used for walking.

8. The retractable finned footwear of claim 1 wherein said fins align in line with said outsole at the bottom of said outsole.

9. The retractable finned footwear of claim 1 wherein the extended said fins spread at sides of said outsole one over the other.

10. The retractable finned footwear of claim 1 wherein the extended said fins provide forward propulsive thrust to users in water.

11. The retractable finned footwear of claim 1 wherein the extended said fins comprises at least one set of fins.

12. The retractable finned footwear of claim 11 wherein said set of fins comprises at least two fins.

13. The retractable finned footwear of claim 11 wherein said set of fins are arranged one over the other.

14. The retractable finned footwear of claim 11 wherein each said set of fins extend at the sides of the front side of the outsole.

15. The retractable finned footwear of claim 11 wherein said set of fins when secured under the outsole takes the size and shape as the outsole.

16. A retractable finned footwear used both in water and land, comprising:

a. an outsole having at least one fin, wherein one end of said at least one fin is rotatably connected at back end of said outsole and other end of said at least one fin is extended outside from front side of said outsole;

b. at least one lever attached to said outsole, wherein said at least one fin are retracted outside and secured back in line with said outsole, by operating said lever, wherein one end of each at least one fin is rotatably connected at back end of said outsole using at least one fastener, wherein said at least one fin is extended by pulling said at least one lever, wherein said at least one fin is secured and aligned in line with said outsole by pushing said lever.

* * * * *